US011333401B2

(12) United States Patent
Akizuki et al.

(10) Patent No.: US 11,333,401 B2
(45) Date of Patent: May 17, 2022

(54) REFRIGERATION CYCLE APPARATUS

(71) Applicant: Mitsubishi Electric Corporation, Tokyo (JP)

(72) Inventors: Takahiro Akizuki, Tokyo (JP); Takuya Ito, Tokyo (JP); Yoshio Yamano, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 177 days.

(21) Appl. No.: 16/609,909

(22) PCT Filed: Jul. 4, 2017

(86) PCT No.: PCT/JP2017/024466
§ 371 (c)(1),
(2) Date: Oct. 31, 2019

(87) PCT Pub. No.: WO2019/008664
PCT Pub. Date: Jan. 10, 2019

(65) Prior Publication Data

US 2020/0200439 A1 Jun. 25, 2020

(51) Int. Cl.
*F25B 5/02* (2006.01)
*F25B 6/04* (2006.01)
(Continued)

(52) U.S. Cl.
CPC ..... *F25B 5/02* (2013.01); *F25B 6/04* (2013.01); *F25B 39/00* (2013.01); *F25B 47/025* (2013.01); *F28D 1/053* (2013.01); *F28F 9/02* (2013.01)

(58) Field of Classification Search
CPC .... F25B 5/02; F25B 6/04; F25B 39/00; F25B 47/025; F25B 2313/003;
(Continued)

(56) References Cited

U.S. PATENT DOCUMENTS 4,034,804 A * 7/1977 Meijer ..... F28D 1/05366 165/148
5,142,879 A * 9/1992 Nakamura ..... F25B 13/00 62/160
(Continued)

FOREIGN PATENT DOCUMENTS

JP S55-29398 U 2/1980
JP S60-048466 A 3/1985
(Continued)

OTHER PUBLICATIONS

Office Action dated Aug. 4, 2020 issued in corresponding JP patent application No. 2019-528227 (and English translation).
(Continued)

*Primary Examiner* — Kun Kai Ma
(74) *Attorney, Agent, or Firm* — Posz Law Group, PLC

(57) ABSTRACT

In a refrigeration cycle apparatus, each set of air heat exchangers among plural sets of air heat exchangers is one set of one or more of single heat exchangers, and the single heat exchangers each have an upper header pipe, a lower header pipe, a heat transfer tube, and a fin. During a cooling operation, a series refrigerant flow path is formed in which refrigerant flows in series through each set of the air heat exchangers; in the series refrigerant flow path, the refrigerant flows downward from above through the heat transfer tubes that all single heat exchangers have. During a heating operation, a parallel refrigerant flow path is formed in which the refrigerant flows in parallel through each set of the air heat exchangers; in the parallel refrigerant flow path, the refrigerant flows upward from below through the heat transfer tubes that all single heat exchangers have.

9 Claims, 5 Drawing Sheets

(51) Int. Cl.

| | |
|---|---|
| ***F25B 39/00*** | (2006.01) |
| ***F25B 47/02*** | (2006.01) |
| ***F28D 1/053*** | (2006.01) |
| ***F28F 9/02*** | (2006.01) |

(58) Field of Classification Search

CPC .. F25B 2313/02541; F25B 2313/02533; F25B 2400/075; F25B 2400/06; F25B 13/00; F25B 47/02; F28D 1/053; F28F 9/02; F24F 1/16

See application file for complete search history.

(56) References Cited

U.S. PATENT DOCUMENTS

| | | | | |
|---|---|---|---|---|
| 10,928,105 | B2 * | 2/2021 | Ito | F25B 13/00 |
| 2011/0094257 | A1 * | 4/2011 | Rusignuolo | F28D 1/0443 62/498 |
| 2012/0042674 | A1 * | 2/2012 | Takenaka | F24F 11/30 62/180 |
| 2013/0269380 | A1 * | 10/2013 | Oya | F25B 13/00 62/190 |
| 2013/0291579 | A1 | 11/2013 | Gao et al. | |
| 2013/0292098 | A1 | 11/2013 | Jindou et al. | |
| 2014/0245766 | A1 * | 9/2014 | Wakamoto | F25B 47/022 62/151 |
| 2015/0083383 | A1 * | 3/2015 | Okazaki | F28F 9/26 165/173 |
| 2015/0114600 | A1 * | 4/2015 | Chen | F28F 19/00 165/104.21 |
| 2015/0276280 | A1 * | 10/2015 | Furui | F25B 13/00 62/160 |
| 2016/0238285 | A1 * | 8/2016 | Kawano | F25B 49/02 |
| 2017/0176057 | A1 * | 6/2017 | Shimodahira | F25B 49/02 |
| 2019/0137148 | A1 * | 5/2019 | Matsuda | F25B 13/00 |
| 2019/0162454 | A1 * | 5/2019 | Hatomura | F24F 11/43 |
| 2019/0383532 | A1 * | 12/2019 | Mizutani | F25B 5/02 |
| 2020/0064031 | A1 * | 2/2020 | Yamano | F25B 41/40 |

FOREIGN PATENT DOCUMENTS

| | | | |
|---|---|---|---|
| JP | H01-120018 | U | 8/1989 |
| JP | 2009-041231 | A | 2/2009 |
| JP | 4391348 | B2 | 12/2009 |
| JP | 2013-541691 | A | 11/2013 |
| JP | 5617935 | B | 9/2014 |
| WO | 2015/063853 | A1 | 5/2015 |

OTHER PUBLICATIONS

International Search Report of the International Searching Authority dated Oct. 3, 2017 for the corresponding International application No. PCT/JP2017/024466 (and English translation).

* cited by examiner

Comparative Example

REFRIGERATION CYCLE APPARATUS

CROSS REFERENCE TO RELATED APPLICATION

This application is a U.S. national stage application of PCT/JP2017/024466 filed on Jul. 4, 2017, the contents of which are incorporated herein by reference.

TECHNICAL FIELD

The present invention relates to a refrigeration cycle apparatus having an air heat exchanger constituted of a single heat exchanger having a large number of heat transfer tubes arranged in parallel.

BACKGROUND ART

Some configuration has been known in which a large number of heat transfer tubes extending in a horizontal direction are arranged in parallel in a heat exchanger for use in an air-conditioning apparatus that is one example of a refrigeration cycle apparatus (e.g., see Patent Literature 1).

In the heat exchanger disclosed in Patent Literature 1, a partition plate is disposed in a vertical header pipe connected to either one of left and right end portions of the heat transfer tube. Consequently, the number of upper and lower refrigerant flow paths divided in the vertical header pipe can be adjusted. As a result, when the heat exchanger is used as a condenser, an appropriate refrigerant flow velocity can be acquired, and a heat exchange performance can improve.

Furthermore, in the heat exchanger, a configuration is known in which a large number of heat transfer tubes extending in a vertical direction are arranged in parallel (e.g., see Patent Literature 2).

In the heat exchanger disclosed in Patent Literature 2, a plurality of expansion portions are provided in a lower header pipe that is an inlet of the heat exchanger. Consequently, refrigerant can be distributed to all flow paths of the heat transfer tube extending upward from the lower header pipe. As a result, when the heat exchanger is used as an evaporator, two-phase refrigerant at the inlet of the heat exchanger can be favorably distributed, and an evaporation performance can improve.

CITATION LIST

Patent Literature

Patent Literature 1: Japanese Patent No. 5617935
Patent Literature 2: Japanese Patent No. 4391348

SUMMARY OF INVENTION

Technical Problem

When a heat exchanger disclosed in Patent Literature 1 is used as an evaporator, however, it is difficult to uniformly distribute refrigerant to flow paths of respective heat transfer tubes in a vertical header pipe, and a heat exchange performance deteriorates.

Furthermore, when a heat exchanger disclosed in Patent Literature 2 is used as a condenser, refrigerant flows into a lower header pipe from a right end portion. Consequently, when the refrigerant is distributed to flow paths of all heat transfer tubes in the lower header pipe, it is difficult to acquire an appropriate refrigerant flow velocity to a left end portion of the lower header pipe, and the heat exchange performance deteriorates.

The present invention has been developed to solve the above problems, and an object of the present invention is to provide a refrigeration cycle apparatus in which an air heat exchanger achieves an optimum heat transfer performance even when the air heat exchanger is used as either one of a condenser and an evaporator, and a heat exchange performance can improve.

Solution to Problem

A refrigeration cycle apparatus according to an embodiment of the present invention has a refrigerant circuit configured to circulate refrigerant and having a compressor, a four-way valve, a plurality of sets of air heat exchangers, an expansion valve, and a load side heat exchanger; each set of air heat exchangers among the plurality of sets of air heat exchangers is one set of one or more of single heat exchangers; the single heat exchangers each have an upper header pipe, a lower header pipe, a large number of heat transfer tubes arranged in parallel and extending in a vertical direction between the upper header pipe and the lower header pipe, and a large number of fins arranged in parallel and extending in a horizontal direction that is orthogonal to the heat transfer tubes; during a cooling operation, a series refrigerant flow path is formed in which the refrigerant flows in series through each set of the air heat exchangers among the plurality of sets of air heat exchangers; in the series refrigerant flow path, the refrigerant flows downward from above through the heat transfer tubes that all the single heat exchangers in the plurality of sets of air heat exchangers have; during a heating operation, a parallel refrigerant flow path is formed in which the refrigerant flows in parallel through each set of the air heat exchangers among the plurality of sets of air heat exchangers; and in the parallel refrigerant flow path, the refrigerant flows upward from below through the heat transfer tubes that all the single heat exchangers in the plurality of sets of air heat exchangers have.

Advantageous Effects of Invention

In a refrigeration cycle apparatus of an embodiment of the present invention, during a cooling operation, a series refrigerant flow path is formed in which refrigerant flows in series through each set of air heat exchangers among a plurality of sets of air heat exchangers. In the series refrigerant flow path, the refrigerant flows downward from above through heat transfer tubes that all single heat exchangers in the plurality of sets of air heat exchangers have. During a heating operation, a parallel refrigerant flow path is formed in which the refrigerant flows in parallel through each set of the air heat exchangers among the plurality of sets of air heat exchangers. In the parallel refrigerant flow path, the refrigerant flows upward from below through the heat transfer tubes that all the single heat exchangers in the plurality of sets of air heat exchangers have. The air heat exchanger therefore achieves an optimum heat transfer performance even when the air heat exchanger is used as either one of a condenser and an evaporator, and a heat exchange performance can improve.

DESCRIPTION OF EMBODIMENTS

Embodiments of the present invention will be described hereinafter with reference to drawings. Note that components denoted with the same reference sign in the respective drawings are the same or equivalent, and reference signs are common throughout the description of the specification. Furthermore, an aspect of a component described in the description of the specification is merely an illustration and is not limited to the description.

Embodiment 1

<Configuration of Air-Conditioning Apparatus>

Figure 1:
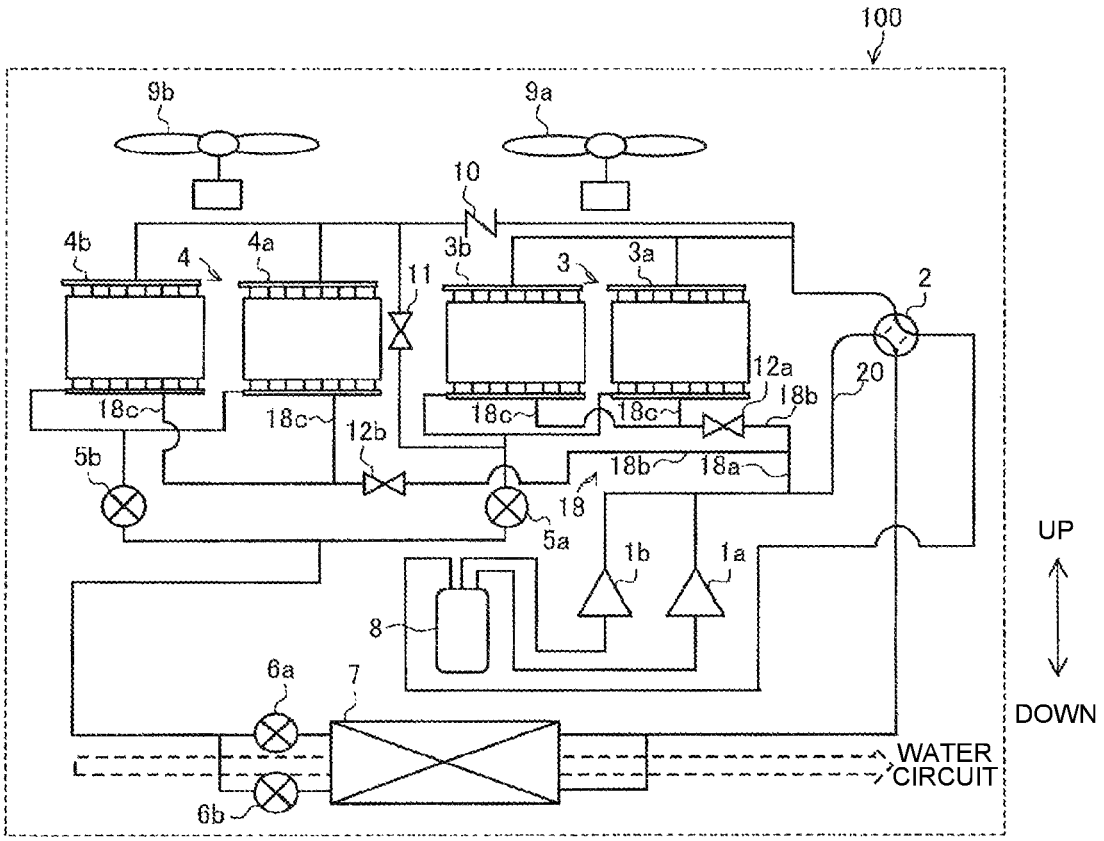
FIG. 1 is a refrigerant circuit diagram illustrating a refrigeration cycle apparatus according to Embodiment 1 of the present invention.

FIG. 1 is a refrigerant circuit diagram illustrating a refrigeration cycle apparatus 100 according to Embodiment 1 of the present invention. The refrigeration cycle apparatus 100 is a chilling unit.

As illustrated in FIG. 1, the refrigeration cycle apparatus 100 has one refrigerant circuit that circulates refrigerant. The one refrigerant circuit has compressors 1*a*, 1*b*, a four-way valve 2, two sets of air heat exchangers 3 and 4, expansion valves 5*a*, 5*b*, 6*a*, 6*b*, and a water heat exchanger 7 that is a load side heat exchanger. The one refrigerant circuit further has an accumulator 8, fans 9*a*, 9*b*, a check valve 10, a solenoid valve 11, and solenoid valves 12*a*, 12*b* that are on-off valves.

The compressors 1*a*, 1*b*, the four-way valve 2, the two sets of air heat exchangers 3 and 4, the expansion valves 5*a*, 5*b*, 6*a*, 6*b*, the water heat exchanger 7, the accumulator 8, the check valve 10, and the solenoid valve 11 connect to a refrigerant pipe 20 of the refrigerant circuit.

One set of air heat exchangers 3 are one set of two single heat exchangers 3*a*, 3*b*. One set of air heat exchangers 4 is one set of two single heat exchangers 4*a*, 4*b*. In the refrigeration cycle apparatus 100, the refrigerant circuit is connected to four single heat exchangers 3*a*, 3*b*, 4*a*, 4*b*. Note that the refrigerant circuit is not limited to having two sets of air heat exchangers 3 and 4, and may have a plurality of sets of air heat exchangers. Furthermore, each set of air heat exchangers among the plurality of sets of air heat exchangers may be one set of one or more single heat exchangers. In particular, each set of air heat exchangers among the plurality of sets of air heat exchangers is preferably one set of two or more single heat exchangers. Additionally, each set of air heat exchangers among the plurality of sets of air heat exchangers is further preferably one set of an even number of single heat exchangers.

The water heat exchanger 7 exchanges heat between the refrigerant flowing through the refrigerant circuit and water of a water circuit, to cool or heat the water. The water cooled or heated in the water heat exchanger 7 circulates through the water circuit to condition air in an object room. Note that the load side heat exchanger as which the water heat exchanger 7 is used in Embodiment 1 may exchange heat between the refrigerant flowing through the refrigerant circuit and the air of the object room.

The fan 9*a* is disposed above the one set of air heat exchangers 3. The fan 9*b* is disposed above the one set of air heat exchangers 4.

The solenoid valves 12*a*, 12*b* are arranged in a high-temperature gas refrigerant pipe 18 that directly connects the compressors 1*a*, 1*b* to two sets of air heat exchangers 3 and 4. The solenoid valves 12*a*, 12*b* are each an on-off valve to be opened and closed depending on whether or not high-temperature gas refrigerant is cause to flow from the compressors 1*a*, 1*b* through the corresponding one of the sets of air heat exchangers 3 and 4 during a defrosting operation.

The high-temperature gas refrigerant pipe 18 directly connects the compressors 1*a*, 1*b* to two sets of air heat exchangers 3 and 4. The high-temperature gas refrigerant pipe 18 has a main pipe 18*a*, first branch pipes 18*b*, and second branch pipes 18*c*. The main pipe 18*a* extends from the compressors 1*a*, 1*b*. Two first branch pipes 18*b* each branch from the main pipe 18*a* to the corresponding one of the sets of air heat exchangers 3 and 4. The solenoid valves 12*a*, 12*b* connect to two respective first branch pipes 18*b*. Two of the second branch pipes 18*c* each connect to the corresponding one of the single heat exchangers 3*a*, 3*b* from part of the first branch pipe 18*b* across the solenoid valve 12*a* toward the one set of air heat exchangers 3. The other two of the second branch pipes 18*c* each connect to the corresponding one of the single heat exchangers 4*a*, 4*b* from part of the first branch pipe 18*b* across the solenoid valve 12*b* toward the one set of air heat exchangers 4.

<Configuration of Air Heat Exchangers 3 and 4>

Figure 2:
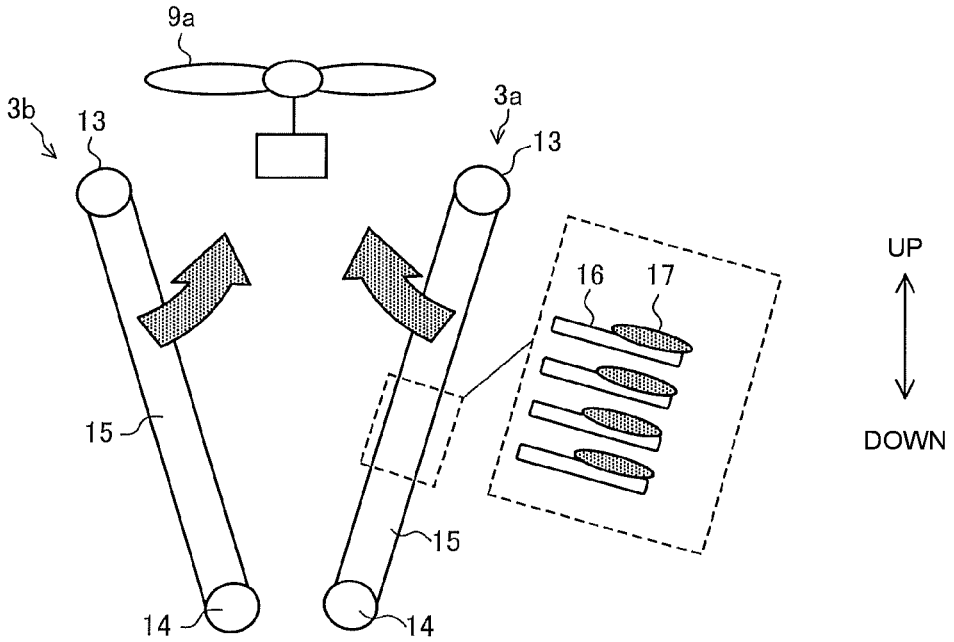
FIG. 2 is an explanatory view illustrating one set of air heat exchangers according to Embodiment 1 of the present invention.

FIG. 2 is an explanatory view illustrating the one set of air heat exchangers 3 according to Embodiment 1 of the present invention. The one set of air heat exchangers 3 is one set of two single heat exchangers 3*a*, 3*b*. The one set of air heat exchangers 4 is one set of two single heat exchangers 4*a*, 4*b* in the same manner as in the one set of air heat exchangers 3.

As illustrated in FIG. 2, in the air heat exchangers 3, two single heat exchangers 3*a*, 3*b* are tilted and arranged in a V-shape in which a space between upper portions of a pair of left and right single heat exchangers is larger than a space between lower portions of the pair. Furthermore, in the air heat exchangers 4 that are not shown in this drawing, two single heat exchangers 4*a*, 4*b* are tilted and arranged in a V-shape in which a space between upper portions of a pair of left and right single heat exchangers is larger than a space between lower portions of the pair in the same manner as in the air heat exchangers 3. Note that each two of the even number of single heat exchangers may form a pair, and the two single heat exchangers may be tilted in a V-shape in which a space between upper portions of the pair is larger than a space between lower portions of the pair.

As illustrated in FIG. 2, the fan 9*a* is disposed above the two single heat exchangers 3*a*, 3*b* on an axis of symmetry when this pair of left and right single heat exchangers are linearly symmetrically arranged. The fan 9*b* that is not shown in this drawing is disposed above the two single heat exchangers 4*a*, 4*b* on an axis of symmetry when this pair of left and right single heat exchangers are linearly symmetrically arranged in the same manner as in the fan 9*a*.

<Configuration of Single Heat Exchangers 3*a*, 3*b*, 4*a*, 4*b*>

Figure 3:
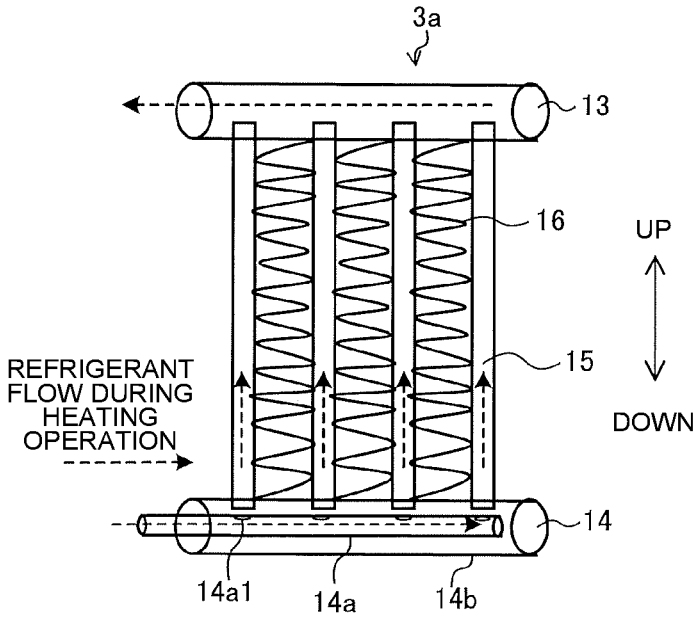
FIG. 3 is a front view illustrating a single heat exchanger according to Embodiment 1 of the present invention.
Figure 4:
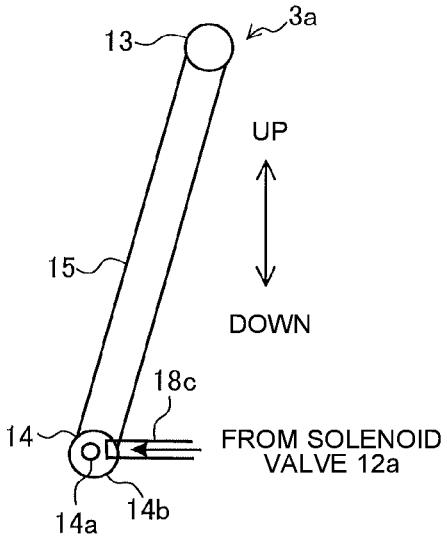
FIG. 4 is a side view illustrating the single heat exchanger according to Embodiment 1 of the present invention.

FIG. 3 is a front view illustrating the single heat exchanger 3*a* according to Embodiment 1 of the present invention. FIG. 4 is a side view illustrating the single heat exchanger 3*a* according to Embodiment 1 of the present invention. Here, the single heat exchanger 3*a* will be described as an example. The other single heat exchangers 3*b*, 4*a*, 4*b* each have a configuration similar to the single heat exchanger 3*a*. As illustrated in FIG. 3 and FIG. 4, the single heat exchanger 3*a* has an upper header pipe 13, a lower header pipe 14, a large number of heat transfer tubes 15, and a large number of corrugate fins 16.

The second branch pipe 18*c* of the high-temperature gas refrigerant pipe 18 is connected to the lower header pipe 14 so that the high-temperature gas refrigerant can directly flow inside from the compressors 1*a*, 1*b*.

The large number of heat transfer tubes 15 are arranged in parallel and extend in a vertical direction between the upper header pipe 13 and the lower header pipe 14. The large number of heat transfer tubes 15 are connected to the upper header pipe 13 and the lower header pipe 14 so that the refrigerant can flow through. Note that as each heat transfer tube 15, a tube such as a flat tube and a round tube is used.

The large number of corrugate fins 16 are arranged in parallel and extend in a horizontal direction that is orthogonal to the large number of heat transfer tubes 15. Air sent by the fan 9*a* flows through a space between the corrugate fins 16 that are adjacent to each other.

<Configuration of Lower Header Pipes 14>

Figure 5:
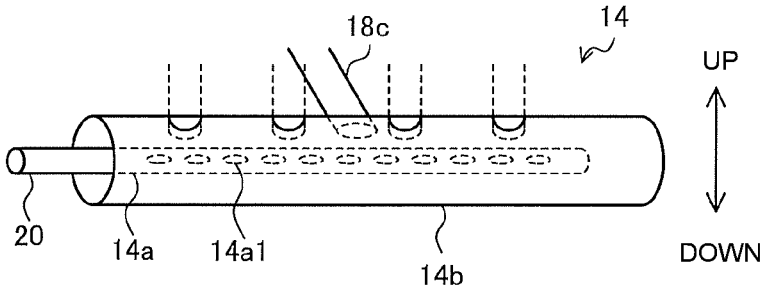
FIG. 5 is a perspective view illustrating a lower header pipe of the single heat exchanger according to Embodiment 1 of the present invention.

FIG. 5 is a perspective view illustrating the lower header pipe 14 of the single heat exchanger 3*a* according to Embodiment 1 of the present invention. As illustrated in FIG. 5, the lower header pipe 14 is a double pipe structure having an inner pipe 14*a* and an outer pipe 14*b*.

The inner pipe 14*a* connects to the refrigerant pipe 20 of the refrigerant circuit, and the refrigerant flows through the inner pipe. One end portion of the inner pipe 14*a* is connected to the refrigerant pipe 20, and the other end portion opposite to the one end portion is closed. In a peripheral wall of the inner pipe 14*a*, a large number of holes 14*a*1 are provided through which the refrigerant flows into and out from the heat transfer tubes 15 via an interior of the outer pipe 14*b*. As illustrated in FIG. 4, a diameter of the inner pipe 14*a* is smaller than a diameter of the upper header pipe 13.

The outer pipe 14*b* encloses the inner pipe 14*a*, and is connected to one of the second branch pipes 18*c* of the high-temperature gas refrigerant pipe 18. The outer pipe 14*b* is a pipe extending in the horizontal direction, and has both end portions closed. The second branch pipe 18*c* of the high-temperature gas refrigerant pipe 18 is connected to the outer pipe 14*b* from the horizontal direction. Each of the large number of heat transfer tubes 15 is connected to the outer pipe 14*b*. The large number of heat transfer tubes 15 are connected to the outer pipe 14*b* from above. As illustrated in FIG. 4, a diameter of the outer pipe 14*b* is substantially equal to the diameter of the upper header pipe 13.

<Action of Cooling Operation>

Figure 6:
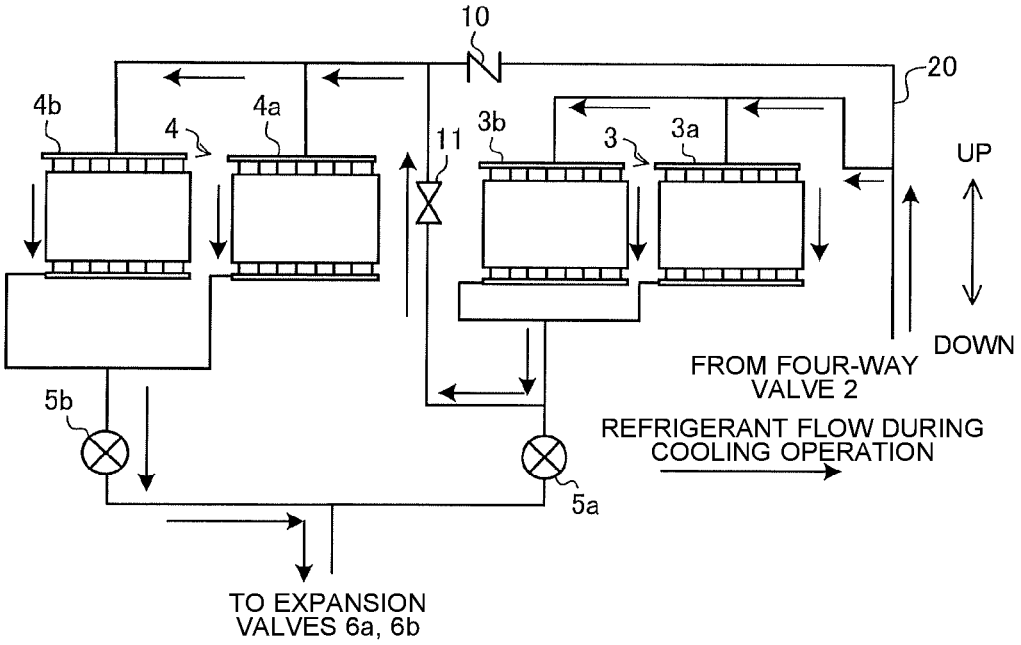
FIG. 6 is an explanatory view illustrating refrigerant flow during a cooling operation of the refrigeration cycle apparatus according to Embodiment 1 of the present invention.

FIG. 6 is an explanatory view illustrating refrigerant flow during a cooling operation of the refrigeration cycle apparatus 100 according to Embodiment 1 of the present invention. The cooling operation and a heating operation are switched by switching flow paths at the four-way valve 2 illustrated in FIG. 1.

As illustrated in FIG. 6, the high-temperature gas refrigerant flowing out from the compressors 1*a*, 1*b* to the four-way valve 2 is first blocked by the check valve 10, and flows into two single heat exchangers 3*a*, 3*b* that constitute the one set of air heat exchangers 3 to exchange heat. In part of the refrigerant pipe 20 connecting to the one set of air heat exchangers 3, a branch refrigerant flow path is formed in which the refrigerant flows in parallel through each of the two single heat exchangers 3*a*, 3*b* that constitute the one set of air heat exchangers 3. In the one set of air heat exchangers 3, the refrigerant flows downward from above through the heat transfer tubes 15 that the two single heat exchangers 3*a*, 3*b* have.

Two-phase refrigerant flowing out from the air heat exchangers 3 flows through part of the refrigerant pipe 20 in which the solenoid valve 11 is disposed, to reach the one set of air heat exchangers 4, as the expansion valve 5*a* closes and the solenoid valve 11 opens. The part of the refrigerant pipe 20 in which the solenoid valve 11 is disposed is a series refrigerant pipe in which the refrigerant flows in series through the set of air heat exchangers 3 and then the set of air heat exchangers 4 of the two sets of air heat exchangers 3 and 4. Consequently, during the cooling operation, the series refrigerant flow path is formed in which the refrigerant flows in series through the set of air heat exchangers 3 and then the set of air heat exchangers 4 in the two sets of air heat exchangers 3 and 4.

Then, the two-phase refrigerant flows into the two single heat exchangers 4*a*, 4*b* that constitute the one set of air heat exchangers 4 to exchange heat. In the part of the refrigerant pipe 20 connecting to the one set of air heat exchangers 4, a branch refrigerant flow path is formed in which the refrigerant flows in parallel through each of the two single heat exchangers 4*a*, 4*b* that constitute the one set of air heat exchangers 4. In the one set of air heat exchangers 4, the refrigerant flows downward from above through the heat transfer tubes 15 that the two single heat exchangers 4*a*, 4*b* have.

Liquid refrigerant flowing out from the air heat exchangers 4 passes through the opened expansion valve 5*b*, and expands through the expansion valves 6*a*, 6*b* to become the two-phase refrigerant that reaches the water heat exchanger 7. The two-phase refrigerant flows into the water heat exchanger 7 to exchange heat, and becomes low-temperature gas refrigerant. In the water heat exchanger 7, the water that exchanges heat with the two-phase refrigerant is cooled, thereby generating cold water.

As described above, in case of the cooling operation, the series refrigerant flow path in which the refrigerant flows in series through the two sets of air heat exchangers 3 and 4 is formed in the refrigerant circuit. Consequently, in the heat transfer tubes 15 of the single heat exchangers 3*a*, 3*b*, 4*a*, 4*b* that constitute the air heat exchangers 3 and 4, fine and long flow paths are formed, and a refrigerant flow velocity and a flow path length are increased in the flow paths of the heat transfer tubes 15. Consequently, when the air heat exchangers 3 and 4 are used as condensers, a heat exchange performance can improve.

<Action of Heating Operation>

Figure 7:
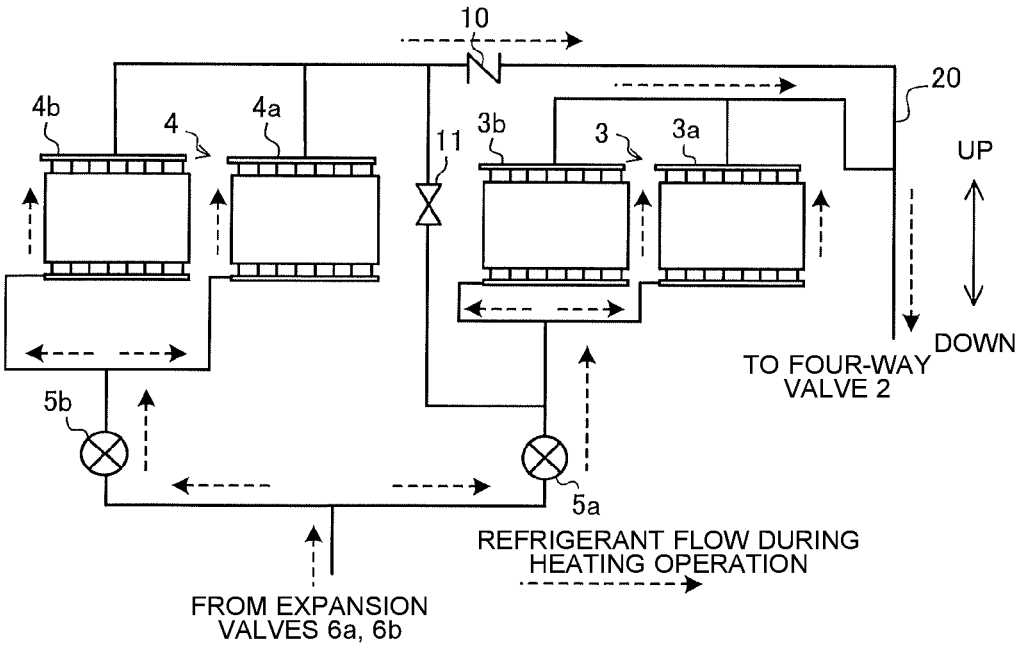
FIG. 7 is an explanatory view illustrating refrigerant flow during a heating operation of the refrigeration cycle apparatus according to Embodiment 1 of the present invention.

FIG. 7 is an explanatory view illustrating refrigerant flow during the heating operation of the refrigeration cycle apparatus 100 according to Embodiment 1 of the present invention. The cooling operation and the heating operation are switched by switching the flow paths at the four-way valve 2 illustrated in FIG. 1.

As illustrated in FIG. 7, the high-temperature gas refrigerant flowing out from the compressors 1*a*, 1*b* to the four-way valve 2 first flows into the water heat exchanger 7 to exchange heat with the water of the water circuit. By this heat exchange, warm water is generated in the water heat exchanger 7. The liquid refrigerant flowing out from the water heat exchanger 7 passes through the opened expansion valves 6*a*, 6*b*, and is distributed to two respective parts of the refrigerant pipe 20 having the opened expansion valves 5*a*, 5*b*, and the refrigerant expands through the expansion valves 5*a*, 5*b*, to become the two-phase refrigerant.

In the heating operation, two expansion valves 5*a*, 5*b* open and the solenoid valve 11 closes. Consequently, the two-phase refrigerant is distributed in parallel to two sets of air heat exchangers 3 and air heat exchangers 4 to exchange heat. Thus, during the heating operation, a parallel refrigerant flow path is formed in which the refrigerant flows in parallel through each set of air heat exchangers 3 and 4 of the two sets of air heat exchangers 3 and 4.

Furthermore, a branch refrigerant flow path is formed in which the refrigerant flows in parallel through each of the single heat exchangers 3*a*, 3*b* that constitute the one set of air heat exchangers 3 and a branch refrigerant flow path is formed in which the refrigerant flows in parallel through each of the single heat exchangers 4*a*, 4*b* that constitute the one set of air heat exchangers 4. That is, the refrigerant flows in parallel through each of four single heat exchangers 3*a*, 3*b*, 4*a*, 4*b*.

In the lower header pipe 14 of each of the single heat exchangers 3*a*, 3*b*, 4*a*, 4*b*, as illustrated in FIG. 5, the inner pipe 14*a* having the large number of holes 14*a*1 with a small diameter is enclosed as a two-phase refrigerant distribution mechanism with the outer pipe 14*b*, and the refrigerant can be uniformly distributed to all the flow paths of the large number of heat transfer tubes 15 connected to the outer pipe 14*b*. Then, in the parallel refrigerant flow path, the refrigerant flows upward from below through the heat transfer tubes 15 that all the single heat exchangers 3*a*, 3*b*, 4*a*, 4*b* in the two sets of air heat exchangers 3 and 4 have.

In case of the heating operation, the refrigerant therefore flows in parallel through the two sets of air heat exchangers 3 and 4. Consequently, the refrigerant can be uniformly distributed to all the flow paths of the large number of heat transfer tubes 15. Consequently, when the air heat exchangers 3 and 4 are used as evaporators, the heat exchange performance can improve.

In this manner, depending on whether the two sets of air heat exchangers 3 and 4 in which the large number of heat transfer tubes 15 are arranged to vertically extend are used as the condensers or the evaporators, the flow of the refrigerant flowing through the air heat exchangers 3 and 4 varies. Consequently, even when the two sets of air heat exchangers 3 and 4 are used as either the condensers or the evaporators, an optimum heat exchange performance can be obtained.

<Operation of Corrugate Fins 16>

Figure 8:
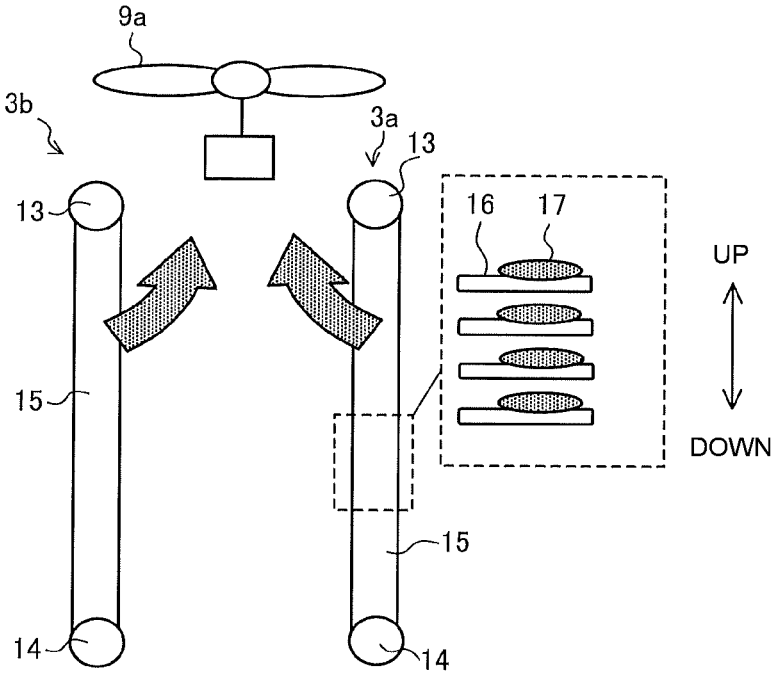
FIG. 8 is an explanatory view illustrating one set of air heat exchangers according to a comparative example.

FIG. 8 is an explanatory view illustrating one set of air heat exchangers 3 according to a comparative example. In the one set of air heat exchangers 3 according to the comparative example, heat transfer tubes 15 are arranged to extend vertically to an up-down direction in each of single heat exchangers 3*a*, 3*b*. That is, two single heat exchangers 3*a*, 3*b* constitute a pair of left and right single heat exchangers in which a space between upper portions of the pair is equal to a space between lower portions of the pair. In the one set of air heat exchangers 3 according to the comparative example, drainage improves as compared with an air heat exchanger in which heat transfer tubes are arranged to extend in a horizontal direction. However, as illustrated in an enlarged view surrounded with a broken line, water drops 17 of, for example, condensed water during a heating operation, ice melt water during a defrosting operation, and water during a sprinkling operation stagnate on the corrugate fins 16 without flowing.

On the other hand, in the one set of air heat exchangers 3 according to Embodiment 1 illustrated in FIG. 2, the two single heat exchangers 3*a*, 3*b* are tilted and arranged in the V-shape in which the space between the upper portions of this pair of left and right single heat exchangers is larger than the space between the lower portions of the pair. That is, the single heat exchangers 3*a*, 3*b* are arranged to be tilted to a vertical direction, and plate surfaces of the corrugate fins 16 are arranged to be tilted to the horizontal direction. Note that the one set of air heat exchangers 4 also has a configuration similar to the one set of air heat exchangers 3. In case of this arrangement, as illustrated in the enlarged view surrounded with the broken line, the water drops 17 generated on the corrugate fins 16 flow downward along tilted surfaces because of an influence of gravity. Consequently, the drainage improves in the air heat exchangers 3 and 4.

When the water drops 17 of the condensed water are generated on the corrugate fins 16 during the heating operation, discharge of the water drops 17 is therefore promoted. Consequently, a heating performance can be inhibited from being deteriorated. Furthermore, when the water drops 17 of the ice melt water are generated on the corrugate fins 16 during the defrosting operation, the discharge of the water drops 17 is promoted. Consequently, ice can be inhibited from being unmelted. Furthermore, the water drops 17 adhering on the corrugate fins 16 during the sprinkling operation can spread throughout the corrugate fins 16 without stagnating. Consequently, a sprinkling effect can be sufficiently produced.

<Actions of Split Defrosting Operation>

Description will be made as to an operation of acquiring a flow rate of the high-temperature gas refrigerant for defrosting during a split defrosting operation of defrosting each set of air heat exchangers 3 or 4, so that a defrosting performance can improve. That is, during the heating operation, split defrosting is individually performed for each set of the two sets of air heat exchangers 3 and 4 while the heating operation is performed.

When the one set of air heat exchangers 3 is to be defrosted during the heating operation, an operation of the fan 9*a* is stopped, the expansion valve 5*a* is closed, and the solenoid valve 12*a* for the defrosting is opened. The fan 9*a*, the expansion valve 5*a*, and the solenoid valve 12*a* correspond to the one set of air heat exchangers 3. Consequently, part of the high-temperature gas refrigerant flows through the high-temperature gas refrigerant pipe 18 and is supplied to the one set of air heat exchangers 3. Consequently, the high-temperature gas refrigerant melts the ice adhering on the one set of air heat exchangers 3. On the other hand, the other set of air heat exchangers 4 continuously performs the heating operation. Consequently, the heat exchange is prevented from being stopped in the water heat exchanger 7 during the split defrosting, and a warm water temperature is inhibited from being lowered because of the heat exchange. After completion of the split defrosting operation of the one set of air heat exchangers 3, the operation of the fan 9*a* is started, the expansion valve 5*a* is operated for a normal heating operation, and the solenoid valve 12*a* for the defrosting is closed. Consequently, the one set of air heat exchangers 3 is returned to the normal heating operation.

Subsequently, when the one set of air heat exchangers 4 is to be defrosted, an operation of the fan 9*b* is stopped, the expansion valve 5*b* is closed, and the solenoid valve 12*b* for the defrosting is opened. The fan 9*b*, the expansion valve 5*b*, the solenoid valve 12*b* correspond to the one set of air heat exchangers 4. Consequently, part of the high-temperature gas refrigerant flows through the high-temperature gas refrigerant pipe 18 and is supplied to the one set of air heat exchangers 4. Consequently, the high-temperature gas refrigerant melts the ice adhering on the one set of air heat exchangers 4. On the other hand, the other set of air heat exchangers 3 continuously performs the heating operation. Consequently, the heat exchange is prevented from being stopped in the water heat exchanger 7 during the split defrosting, and the warm water temperature is inhibited from being lowered because of the heat exchange. After completion of the split defrosting operation of the one set of air heat exchangers 4, the operation of the fan 9*b* is started, the expansion valve 5*b* is operated for the normal heating operation, and the solenoid valve 12*b* for the defrosting is closed. Consequently, the one set of air heat exchangers 4 is returned to the normal heating operation.

<Operation of High-Temperature Gas Refrigerant Pipe 18>

In case of some configuration in which the high-temperature gas refrigerant pipe 18 for the defrosting is connected to part of the refrigerant pipe 20 connecting to the single heat exchangers 3*a*, 3*b*, 4*a*, 4*b*, the high-temperature gas refrigerant passes through the inner pipes 14*a* of the lower header pipes 14 to flow into the single heat exchangers 3*a*, 3*b*, 4*a*, 4*b*. Consequently, there are problems in that pressure loss increases, the flow rate of the high-temperature gas refrigerant for the defrosting decreases, and the defrosting performance deteriorates. However, in Embodiment 1, as illustrated in FIG. 4 and FIG. 5, the second branch pipe 18*c* of the high-temperature gas refrigerant pipe 18 for the defrosting does not reach the inner pipe 14*a* of the lower header pipe 14 and is connected to the outer pipe 14*b*. Consequently, the high-temperature gas refrigerant from the high-temperature gas refrigerant pipe 18 for the defrosting does not pass through the inner pipes 14*a* and flows from the interior of the outer pipes 14*b* directly into the single heat exchangers 3*a*, 3*b*, 4*a*, 4*b*. Consequently, the high-temperature gas refrigerant from the high-temperature gas refrigerant pipe 18 is not mixed with the refrigerant in the refrigerant pipe 20. As a result, the increase of the pressure loss can be inhibited, the decrease of the flow rate of the high-temperature gas refrigerant for the defrosting can be inhibited, and the defrosting performance can improve.

Effect of Embodiment 1

The refrigerant circuit that circulates the refrigerant has the compressors 1*a*, 1*b*, the four-way valve 2, two sets of air heat exchangers 3 and 4, the expansion valves 5*a*, 5*b*, 6*a*, 6*b*, and the water heat exchanger 7. The two sets of air heat exchangers 3 and 4 are one set of two single heat exchangers 3*a*, 3*b* and one set of two single heat exchangers 4*a*, 4*b*. Each of the single heat exchangers 3*a*, 3*b*, 4*a*, 4*b* has the upper header pipe 13, the lower header pipe 14, the large number of heat transfer tubes 15 arranged in parallel and extending in the vertical direction between the upper header pipe 13 and the lower header pipe 14, and the large number of corrugate fins 16 arranged in parallel and extending in the horizontal direction that is orthogonal to the heat transfer tubes 15. During the cooling operation, the series refrigerant flow path is formed in which the refrigerant flows in series through the set of air heat exchangers 3 and then the set of air heat exchangers 4 of the two sets of air heat exchangers 3 and 4. In the series refrigerant flow path, the refrigerant flows downward from above through the heat transfer tubes 15 that all the single heat exchangers 3*a*, 3*b*, 4*a*, 4*b* in the two sets of air heat exchangers 3 and 4 have. During the heating operation, the parallel refrigerant flow path is formed in which the refrigerant flows in parallel through each set of air heat exchangers 3 and 4 of the two sets of air heat exchangers 3 and 4. In the parallel refrigerant flow path, the refrigerant flows upward from below through the heat transfer tubes 15 that all the single heat exchangers 3*a*, 3*b*, 4*a*, 4*b* in the two sets of air heat exchangers 3 and 4 have.

With this configuration, a density difference between gas refrigerant and liquid refrigerant is taken into consideration, and the refrigerant flows downward from above through the heat transfer tubes 15 to condense the refrigerant during the cooling operation. Consequently, the air heat exchangers 3 and 4 achieve an optimum heat transfer performance as the condensers. At this time, the series refrigerant flow path is formed. A refrigerant flow velocity and a flow path length in the heat transfer tubes 15 of the two sets of air heat exchangers 3 and 4 can therefore be increased, and the performance of the condensers can further improve. Furthermore, the density difference between the gas refrigerant and the liquid refrigerant is taken into consideration, and the refrigerant flows upward from below through the heat transfer tubes 15 to evaporate the refrigerant during the heating operation. Consequently, the air heat exchangers 3 and 4 achieve the optimum heat transfer performance as the evaporators. At this time, the parallel refrigerant flow path is formed. In the two sets of air heat exchangers 3 and 4, the refrigerant can therefore be uniformly distributed to the flow paths of all the heat transfer tubes 15, and the performance of the evaporators can further improve. Consequently, the air heat exchangers 3 and 4 can achieve the optimum heat transfer performance even when the air heat exchangers 3 and 4 are used as either ones of the condensers and the evaporators, and the heat exchange performance can improve.

The two sets of air heat exchangers 3 and 4 are one set of two single heat exchangers 3*a*, 3*b* and one set of two single heat exchangers 4*a*, 4*b*. In the refrigerant circuit, the branch refrigerant flow path is formed in which the refrigerant flows in parallel through each of the single heat exchangers 3*a*, 3*b*, 4*a*, 4*b* that constitute the sets of air heat exchangers 3 and 4.

With this configuration, the air heat exchangers 3 has two separated single heat exchangers 3*a*, 3*b* and the air heat exchangers 4 has two separated single heat exchangers 4*a*, 4*b*, and the air heat exchangers 3 and 4 can be miniaturized as compared with a case where one large air heat exchanger is used. This configuration facilitates arrangement change in design. Furthermore, the branch refrigerant flow path is formed in which the refrigerant flows in parallel through each of the single heat exchangers 3*a*, 3*b*, 4*a*, 4*b*. Consequently, the refrigerant can be uniformly distributed to the flow paths of all the heat transfer tubes 15 in the two sets of air heat exchangers 3 and 4, and the performance of the evaporators can further improve.

The single heat exchangers 3*a*, 3*b*, 4*a*, 4*b* are arranged to be tilted to the vertical direction, and the plate surfaces of the corrugate fins 16 are arranged to be tilted to the horizontal direction.

With this configuration, the water drops 17 of the condensed water during the heating operation, the ice melt water during the defrosting operation, and the water during the sprinkling operation can be easily discharged from surfaces of the corrugate fins 16. Furthermore, the single heat exchangers 3*a*, 3*b*, 4*a*, 4*b* are arranged to be tilted to the vertical direction, and a height of installed components can be reduced.

The two sets of air heat exchangers 3 and 4 are one set of the even number of single heat exchangers 3*a*, 3*b* and one set of the even number of single heat exchangers 4*a*, 4*b*. Each two of the even number of single heat exchangers 3*a*, 3*b* form a pair and each two of the even number of single heat exchangers 4*a*, 4*b* form a pair. The two single heat exchangers in each pair are tilted and arranged in the V-shape in which the space between the upper portions of the pair is larger than the space between the lower portions of the pair.

With this configuration, the water drops 17 of the condensed water during the heating operation, the ice melt water during the defrosting operation, and the water during the sprinkling operation can be easily discharged from the surfaces of the corrugate fins 16. Furthermore, the single heat exchangers 3*a*, 3*b*, 4*a*, 4*b* are arranged to be tilted to the vertical direction, and the height of the installed components can be reduced. Furthermore, a gap can be opened between lower portions of refrigeration cycle apparatuses 100 that are adjacent to each other, and this configuration makes it easy for a maintenance technician to perform maintenance. Additionally, with the refrigeration cycle apparatus 100 having an outlet in its top, air smoothly flows, and pressure loss can be decreased.

The high-temperature gas refrigerant pipe 18 connecting to the compressors 1*a*, 1*b* is connected to the lower header pipe 14 of each of the single heat exchangers 3*a*, 3*b*, 4*a*, 4*b*.

With this configuration, the high-temperature gas refrigerant from the compressors 1*a*, 1*b* can be supplied to each lower header pipe 14 during the defrosting operation. Then, the high-temperature gas refrigerant flows from the lower header pipe 14 through the heat transfer tubes 15 to reach the upper header pipe 13. Consequently, each single heat exchanger can be effectively defrosted during the defrosting operation.

The lower header pipe 14 of each of the single heat exchangers 3*a*, 3*b*, 4*a*, 4*b* has the inner pipe 14*a* through which the refrigerant flows, and the outer pipe 14*b* enclosing the inner pipe 14*a* and connected to the high-temperature gas refrigerant pipe 18. The heat transfer tubes 15 are connected to the outer pipe 14*b*. In the inner pipe 14*a*, the holes 14*a*1 are provided through which the refrigerant flows into and out from the heat transfer tubes 15 via the interior of the outer pipe 14*b*.

With this configuration, the lower header pipe 14 can be efficiently connected to the refrigerant pipe 20 through which the refrigerant to be supplied to the large number of heat transfer tubes 15 flows inside and outside, and the high-temperature gas refrigerant pipe 18 that is one pipe connected to the lower header pipe 14. Furthermore, as for the lower header pipe 14, a large number of holes 14*a*1 are made in the inner pipe 14*a* enclosed with the outer pipe 14*b* and having a thickness smaller than that of the upper header pipe 13, so that the refrigerant is distributed into the lower header pipe 14 through the holes 14*a*1. Consequently, an appropriate refrigerant flow velocity can be easily acquired to an end portion of the lower header pipe 14 opposite to the other end portion connected to the refrigerant pipe 20. Consequently, the refrigerant can be uniformly distributed to all the heat transfer tubes 15 of the single heat exchangers 3*a*, 3*b*, 4*a*, 4*b*, and the performance of the evaporators can further improve.

The high-temperature gas refrigerant pipe 18 has the first branch pipes 18*b* each branching from the main pipe 18*a* connecting to the compressors 1*a*, 1*b* to the corresponding one of the sets of air heat exchangers 3 and 4. One of the first branch pipes 18*b* is provided with the solenoid valve 12*a* to be opened and closed depending on whether or not the high-temperature gas refrigerant is cause to flow from the compressors 1*a*, 1*b* through the set of air heat exchangers 3 during the defrosting operation. The other one of the first branch pipes 18*b* is provided with the solenoid valve 12*b* to be opened and closed depending on whether or not the high-temperature gas refrigerant is cause to flow from the compressors 1*a*, 1*b* through the set of air heat exchangers 4 during the defrosting operation. The high-temperature gas refrigerant pipe 18 has two of the second branch pipes 18*c* each connecting to the corresponding one of the single heat exchangers 3*a*, 3*b* from part of the one of the first branch pipes 18*b* across the solenoid valve 12*a* toward the one set of air heat exchangers 3 and two of the second branch pipes 18*c* each connecting to the corresponding one of the single heat exchangers 4*a*, 4*b* from part of the other one of the first branch pipes 18*b* across the solenoid valve 12*b* toward the one set of air heat exchangers 4.

With this configuration, in the high-temperature gas refrigerant pipe 18, the high-temperature gas refrigerant flows from the compressors 1*a*, 1*b* through the main pipe 18*a*, the corresponding one of the first branch pipes 18*b*, the corresponding one of the solenoid valves 12*a*, 12*b* and the corresponding ones of the second branch pipes 18*c* to either one of the sets of air heat exchangers 3 or 4 during the defrosting operation. Consequently, the other set of air heat exchangers 3 or 4 continues the heating operation during the defrosting operation, and a heating capacity can be inhibited from being deteriorated.

The load side heat exchanger is the water heat exchanger 7 that exchanges heat between water and the refrigerant in the refrigerant circuit.

With this configuration, the water heat exchanger 7 can exchange heat between the refrigerant and the water after the heat of the refrigerant is efficiently exchanged in the air heat exchangers 3 and 4 of the refrigerant circuit.

In the refrigeration cycle apparatus 100 that is a refrigerant circuit apparatus, the water of which heat is exchanged by the water heat exchanger 7 is for use in air conditioning.

With this configuration, the air can be conditioned by using the refrigerant subjected to the efficient heat exchange by the air heat exchangers 3 and 4 of the refrigerant circuit.

Embodiment 2

<Configuration of Refrigeration Cycle Apparatus 100>

Figure 9:
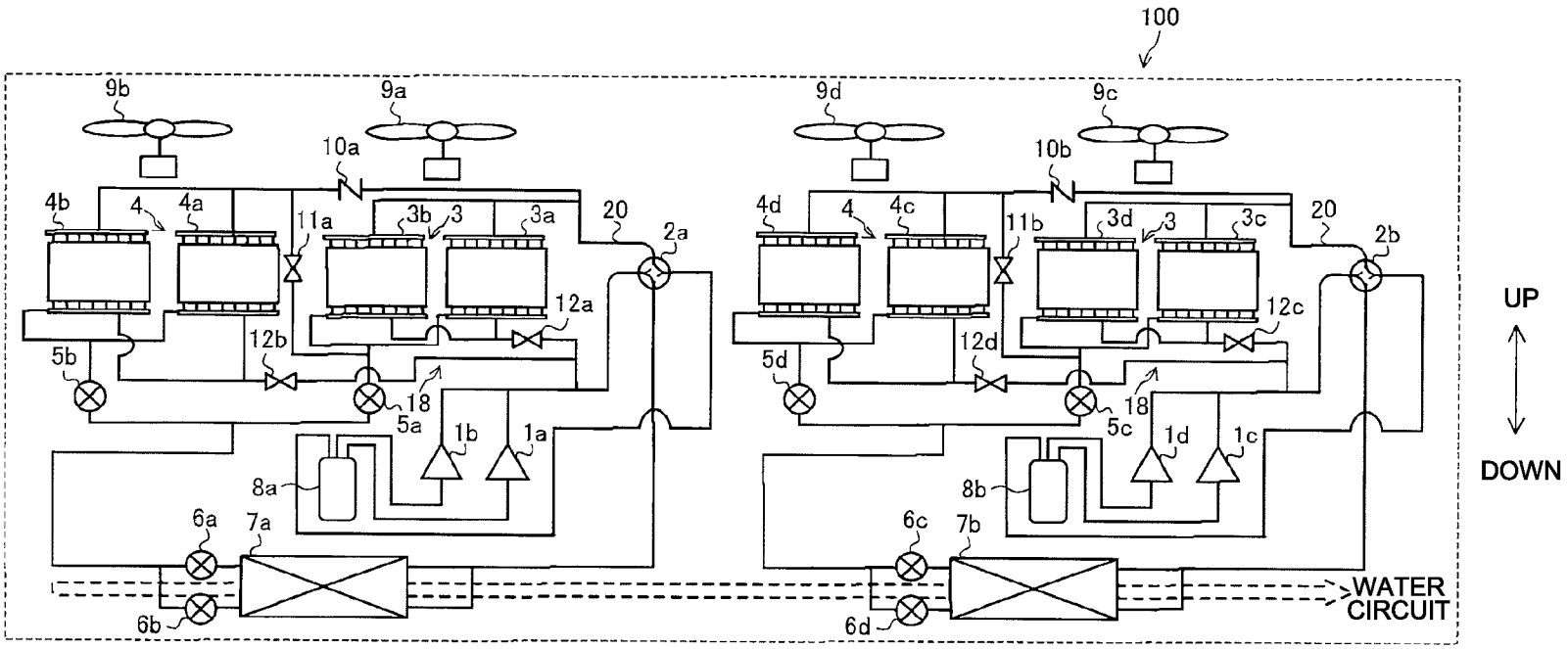
FIG. 9 is a refrigerant circuit diagram illustrating a refrigeration cycle apparatus according to Embodiment 2 of the present invention.

FIG. 9 is a refrigerant circuit diagram illustrating a refrigeration cycle apparatus 100 according to Embodiment 2 of the present invention. The refrigeration cycle apparatus 100 is a chilling unit. The refrigeration cycle apparatus 100 has two refrigerant circuits in one housing. In Embodiment 2, only characteristic parts will be described, and description of a configuration and an operation similar to those of Embodiment 1 is omitted.

As illustrated in FIG. 9, a first refrigerant circuit has compressors 1*a*, 1*b*, a four-way valve 2*a*, two sets of air heat exchangers 3 and 4, expansion valves 5*a*, 5*b*, 6*a*, 6*b*, and a water heat exchanger 7*a* that is a load side heat exchanger. The first refrigerant circuit further has an accumulator 8*a*, fans 9*a*, 9*b*, a check valve 10*a*, a solenoid valve 11*a*, and solenoid valves 12*a*, 12*b* that are on-off valves. The one set of air heat exchangers 3 is one set of two single heat exchangers 3*a*, 3*b*. The one set of air heat exchangers 4 is one set of two single heat exchangers 4*a*, 4*b*.

A second refrigerant circuit has compressors 1*c*, 1*d*, a four-way valve 2*b*, two sets of air heat exchangers 3 and 4, expansion valves 5*c*, 5*d*, 6*c*, 6*d*, and a water heat exchanger 7*b* that is a load side heat exchanger. The second refrigerant circuit further has an accumulator 8*b*, fans 9*c*, 9*d*, a check valve 10*b*, a solenoid valve 11*b*, and solenoid valves 12*c*, 12*d* that are on-off valves. The one set of air heat exchangers 3 is one set of two single heat exchangers 3*c*, 3*d*. The one set of air heat exchangers 4 is one set of two single heat exchangers 4*c*, 4*d*.

As described above, in two refrigerant circuits, four sets of air heat exchangers 3 and 4 are connected. In the two refrigerant circuits, the water heat exchangers 7*a*, 7*b* are connected in series with a water circuit.

<Actions of Split Defrosting Operation>

In Embodiment 2, a flow rate of high-temperature gas refrigerant for defrosting is acquired during a split defrosting operation of defrosting each set of air heat exchangers 3 or 4, and a defrosting performance can further improve in the same manner as in Embodiment 1. That is, during a heating operation, the four sets of air heat exchangers 3 and 4 are split and each set is individually defrosted while the heating operation is performed. Consequently, all the air heat exchangers 3 and 4 are split into four sets and each set is defrosted. Consequently, a temperature of warm water can be further inhibited from being lowered during the split defrosting.

Effect of Embodiment 2

Two refrigerant circuits are provided. During the defrosting operation, the solenoid valves 12*a*, 12*b*, 12*c*, 12*d* are each opened to the corresponding one of the sets of air heat exchangers 3 and 4 in the two refrigerant circuits.

With this configuration, in the high-temperature gas refrigerant pipe 18, the high-temperature gas refrigerant flows from the compressors 1*a*, 1*b* or the compressors 1*c*, 1*d* to the corresponding one of the sets of air heat exchangers 3 and 4 in the two refrigerant circuits during the defrosting operation by the corresponding one of the solenoid valves 12*a*, 12*b*, 12*c*, 12*d*. Consequently, while one of the sets of air heat exchangers 3 and 4 is being defrosted during the defrosting operation, the other ones of the sets of air heat exchangers 3 and 4 having a larger number of the sets continue the heating operation, among all the sets of air heat exchangers 3 and 4 in the two refrigerant circuits, and deterioration of a heating capacity can be inhibited as much as possible.

<Others>

The above description is the description as to the refrigeration cycle apparatus 100 as which the chilling unit is used. However, the refrigeration cycle apparatus can be utilized also as another refrigeration cycle apparatus such as a direct expansion refrigerator and an air-conditioning apparatus. Furthermore, use of two sets of air heat exchangers 3 and 4 is described as an example of use of a plurality of sets of air heat exchangers. However, the plurality of sets of air heat exchangers can be applied also to an apparatus having three or more sets of air heat exchangers. Furthermore, in the description of the refrigerant circuit, the apparatus having one or two refrigerant circuits is described as an example. However, the refrigeration cycle apparatus can be applied also to another refrigeration cycle apparatus having three or more refrigerant circuits.

REFERENCE SIGNS LIST

1*a* compressor, 1*b* compressor, 1*c* compressor, 1*d* compressor, 2 four-way valve, 2*a* four-way valve, 2*b* four-way valve, 3 air heat exchanger, 3*a* single heat exchanger, 3*b* single heat exchanger, 3*c* single heat exchanger, 3*d* single heat exchanger, 4 air heat exchanger, 4*a* single heat exchanger, 4*b* single heat exchanger, 4*c* single heat exchanger, 4*d* single heat exchanger, 5*a* expansion valve, 5*b* expansion valve, 5*c* expansion valve, 5*d* expansion valve, 6*a* expansion valve, 6*b* expansion valve, 6*c* expansion valve, 6*d* expansion valve, 7 water heat exchanger, 7*a* water heat exchanger, 7*b* water heat exchanger, 8 accumulator, 8*a* accumulator, 8*b* accumulator, 9*a* fan, 9*b* fan, 9*c* fan, 9*d* fan, 10 check valve, 10*a* check valve, 10*b* check valve, 11 solenoid valve, 11*a* solenoid valve, 11*b* solenoid valve, 12*a* solenoid valve, 12*b* solenoid valve, 12*c* solenoid valve, 12*d* solenoid valve, 13 upper header pipe, 14 lower header pipe, 14*a* inner pipe, 14*a*1 hole, 14*b* outer pipe, 15 heat transfer tube, 16 corrugate fin, 17 water drop, 18 high-temperature gas refrigerant pipe, 18*a* main pipe, 18*b* first branch pipe, 18*c* second branch pipe, 20 refrigerant pipe, and 100 refrigeration cycle apparatus

The invention claimed is:

1. A refrigeration cycle apparatus, comprising a refrigerant circuit configured to circulate refrigerant and having a compressor, a four-way valve, a plurality of sets of air heat exchangers, an expansion valve, and a load side heat exchanger, each set of air heat exchangers among the plurality of sets of air heat exchangers comprising one set of two or more of single heat exchangers, the single heat exchangers each having an upper header pipe, a lower header pipe, a plurality of heat transfer tubes arranged in parallel and extending in a vertical direction between the upper header pipe and the lower header pipe, and a plurality of fins arranged in parallel and extending in a horizontal direction that is orthogonal to the heat transfer tubes, during a cooling operation, a series refrigerant flow path being formed in which the refrigerant flows in series through each set of the air heat exchangers among the plurality of sets of air heat exchangers, in the series refrigerant flow path, the refrigerant flowing downward from above through the heat transfer tubes that all the single heat exchangers in the plurality of sets of air heat exchangers have, during a heating operation, a parallel refrigerant flow path being formed in which the refrigerant flows in parallel through each set of the air heat exchangers among the plurality of sets of air heat exchangers, in the parallel refrigerant flow path, the refrigerant flowing upward from below through the heat transfer tubes that all the single heat exchangers in the plurality of sets of air heat exchangers have, in the refrigerant circuit, a branch refrigerant flow path being formed in which the refrigerant flows in parallel through each of the single heat exchangers constituting the one set of the air heat exchangers.

2. The refrigeration cycle apparatus of claim 1, wherein the single heat exchangers are arranged to be tilted to a vertical direction, and plate surfaces of the fins are arranged to be tilted to a horizontal direction.

3. The refrigeration cycle apparatus of claim 2, wherein each set of the air heat exchangers among the plurality of sets of air heat exchangers comprises one set of an even number of the single heat exchangers, and each two of the even number of the single heat exchangers form a pair, the two of the single heat exchangers being tilted and arranged in a V-shape in which a space between upper portions of the pair is larger than a space between lower portions of the pair.

4. The refrigeration cycle apparatus of claim 1, wherein a high-temperature gas refrigerant pipe connecting to the compressor is connected to the lower header pipe of each of the single heat exchangers.

5. The refrigeration cycle apparatus of claim 4, wherein the lower header pipe of each of the single heat exchangers has an inner pipe through which the refrigerant flows, and an outer pipe enclosing the inner pipe and connected to the high-temperature gas refrigerant pipe, the heat transfer tubes are connected to the outer pipe, and in a peripheral wall of the inner pipe, at least one hole is provided through which the refrigerant flows into and out from each of the heat transfer tubes via an interior of the outer pipe.

6. The refrigeration cycle apparatus of claim 4, wherein the high-temperature gas refrigerant pipe has a first branch pipe branching to each set of the air heat exchangers from a main pipe connecting to the compressor, the first branch pipe is provided with an on-off valve to be opened and closed depending on whether or not high-temperature gas refrigerant is cause to flow from the compressor through a corresponding one of the sets of the air heat exchangers during a defrosting operation, and the high-temperature gas refrigerant pipe has a second branch pipe connecting to each of the single heat exchangers from part of the first branch pipe across the on-off valve toward the one set of the air heat exchangers.

7. The refrigeration cycle apparatus of claim 6, wherein a plurality of the refrigerant circuits are provided, and during the defrosting operation, the on-off valve is opened to any one set of the air heat exchangers in the plurality of the refrigerant circuits.

8. The refrigeration cycle apparatus of claim 1, wherein the load side heat exchanger is a water heat exchanger that exchanges heat between water and the refrigerant in the refrigerant circuit.

9. The refrigeration cycle apparatus of claim 8, wherein the water of which heat is exchanged by the water heat exchanger is for use in air conditioning.

* * * * *